US008708768B2

(12) United States Patent
Fahnline

(10) Patent No.: US 8,708,768 B2
(45) Date of Patent: Apr. 29, 2014

(54) WHIRLPOOL TOY

(76) Inventor: Richard Alan Fahnline, Evergreen, CO (US)

( * ) Notice: Subject to any disclaimer, the term of this patent is extended or adjusted under 35 U.S.C. 154(b) by 406 days.

(21) Appl. No.: 13/108,565

(22) Filed: May 16, 2011

(65) Prior Publication Data

US 2011/0217899 A1 Sep. 8, 2011

Related U.S. Application Data

(63) Continuation-in-part of application No. 12/012,550, filed on Feb. 4, 2008, now Pat. No. 7,959,484.

(51) Int. Cl.
*A63H 23/00* (2006.01)
*A63H 29/10* (2006.01)

(52) U.S. Cl.
USPC ..... 446/153; 446/176

(58) Field of Classification Search
USPC ..... 446/153, 159, 167, 176, 178, 180, 217, 446/218, 267, 483; 4/496, 541.1–541.6; 472/65, 67, 128, 129, 137; 434/276; 40/405, 427, 429, 440
See application file for complete search history.

(56) References Cited

U.S. PATENT DOCUMENTS

| | | | | |
|---|---|---|---|---|
| 586,718 | A | 7/1897 | Wharton, Jr. | |
| 3,010,247 | A * | 11/1961 | Shapiro | 446/159 |
| 3,099,986 | A * | 8/1963 | Guelfi | 4/541.6 |
| 3,308,574 | A * | 3/1967 | Schneider | 446/153 |
| 3,372,873 | A | 3/1968 | Weiss | |
| 4,206,565 | A | 6/1980 | Goldfarb | |
| 4,258,912 | A | 3/1981 | Reighart, II | |
| 4,625,780 | A * | 12/1986 | Burnham | 141/319 |
| 4,717,076 | A * | 1/1988 | Notkin | 239/467 |
| D310,717 | S | 9/1990 | Heiligenstein | |
| 5,095,467 | A | 3/1992 | Matsui | |
| 5,272,604 | A | 12/1993 | Lin | |
| 5,616,083 | A | 4/1997 | Subbaramen | |
| D428,155 | S | 7/2000 | Chalberg et al. | |
| 6,241,359 | B1 | 6/2001 | Lin | |
| 6,295,749 | B1 * | 10/2001 | Lin | 40/406 |
| 6,681,508 | B2 | 1/2004 | Unger et al. | |
| 7,959,484 | B2 * | 6/2011 | Fahnline | 446/153 |
| 2011/0138661 | A1 * | 6/2011 | Fuller et al. | 40/406 |

* cited by examiner

*Primary Examiner* — Gene Kim
*Assistant Examiner* — Alyssa Hylinski
(74) *Attorney, Agent, or Firm* — Mark D. Trenner; Trenner Law Firm, LLC

(57) ABSTRACT

A whirlpool toy for use in a partially enclosed household fixture having water therein and having a drain. An example of the whirlpool toy comprises a generally cylindrical body having a generally cylindrical upper chamber, the body having a top allowing a clear view of the upper chamber and at least one generally vertical side wall. A first outlet aperture is formed in a bottom of the upper chamber, located near a center of the bottom of the upper chamber. A lower chamber is connected to the upper chamber by the first outlet aperture, and has an open bottom offering a flow connection to the exterior of the device. The lower chamber extends beyond and is offset from the upper chamber. At least one inlet slot extends vertically up a portion of the at least one generally vertical side wall. A third chamber may be connected above the lower chamber offset to allow for the removal of objects drawn down into the lower chamber.

19 Claims, 13 Drawing Sheets

WHIRLPOOL TOY

PRIORITY CLAIM

This application claims the full benefit and priority filing date as a continuation-in-part (CIP) patent application of U.S. patent application Ser. No. 12/012,550 filed on Feb. 4, 2008 now U.S. Pat. No. 7,959,484, and incorporated herein by reference for all that is disclosed as if fully set forth herein.

BACKGROUND

Toys for use in water tend to fall into a small number of types. There are floating devices such as rubber ducks. There are squirting devices like squirt guns. There are small numbers of animals which absorb water to expand from a tiny size to a small size. However, there are a limited number of scientific toys.

Scientific toys for the bath tend to be demonstrations of buoyancy: submarines and the like. One typical item would be U.S. Pat. No. 4,206,565 issued Jun. 10, 1980 to Goldfarb.

While there are references to "whirlpool bathtubs", these are not toys at all but rather bathtubs with jets to provide a massage to a user of the tub. U.S. Design Patent D428155 issued to Chalberg et al Jul. 11, 2000 is an example of this, as is U.S. Design Patent D310717 issued to Heiligenstein on Sep. 18, 1990.

Another category of items concerns water park and amusement park rides. A number of such devices have whirlpools, waves, tubes or the like. U.S. Pat. No. 5,616,083 issued to Subbaraman et al on Apr. 1, 1997 is an example of this, as is U.S. Pat. No. 586,718 issued Jul. 20, 1897 to Wharton, Jr.

Another category of items are devices for use in creating an air vortex using a fan, air jets, and similar items. U.S. Pat. No. 5,096,467 issued to Matsui on Mar. 17, 2002 is an example of this.

Yet another type of item is material handling apparatus for scientific or production work, for example, U.S. Pat. No. 3,372,873 issued to Weiss on Mar. 12, 1968.

Finally, a number of display items having clear cylindrical sides and machinery for creating a whirlpool in a standing body of liquid within the cylinder are known. These do not relate to bathtubs, drain powered vortexes or the like. Examples include: U.S. Pat. No. 4,258,912 issued Mar. 31, 1981 to Reighart, II and U.S. Pat. No. 5,272,604 to Lin on Dec. 21, 1993, and U.S. Pat. No. 6,241,359 issued Jun. 5, 2001 to Lin and U.S. Pat. No. 6,295,749 issued Oct. 2, 2001 to Lin and U.S. Pat. No. 6,681,503 issued Jan. 27, 2004 to Unger et al.

None of the cited references teach that an ordinary, non-jetted bathtub drain may be used to power s whirlpool for education and amusement of children. None of these devices teach a cylindrical body having a drain dimensioned and configured to sit atop a household bath or sink drain, a recuperation chamber, a gasket sized to secure the device to a bathtub surface, and a hole having liquid access to a household drain.

DETAILED DESCRIPTION

Figure 1:
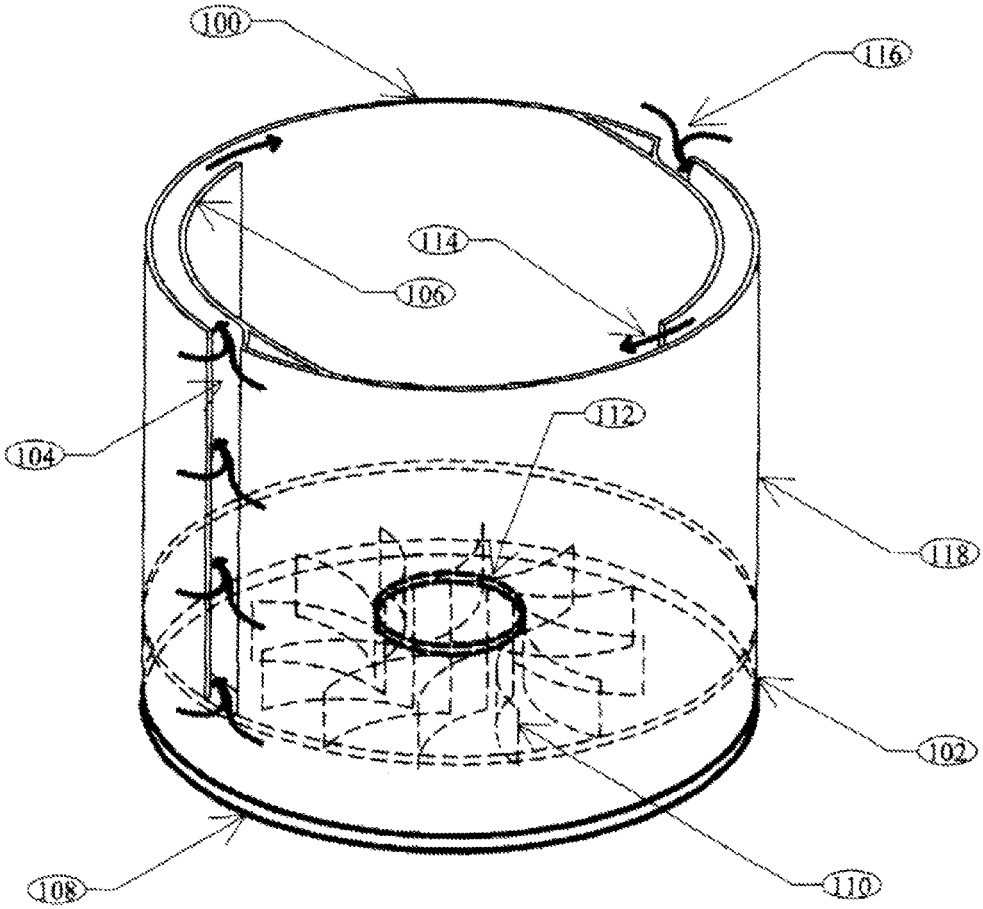
FIG. 1 is a partially transparent perspective view of an embodiment of the device.

A whirlpool toy and educational device has a bottom and gasket designed to allow the device to fit over the drain of a household fixture such as a bathtub or sink, even though such drains may be set quite close to the edge of the basin, and many basins do not have flat bottoms.

The device has a generally cylindrical interior space (upper chamber) with a clear or open top, and further having inlet slots or vanes set at an angle, so that water entering the interior from the bath will begin to rotate within the interior space immediately upon entrance. A centrally placed outlet in the bottom of the interior space leads to a lower chamber (second interior space) having an offset lower chamber outlet allowing the lower chamber outlet to sit directly over a bathtub drain and thus allowing water to exit the lower chamber directly to the bathtub drain. The lower chamber may have a plurality of vanes/fins designed to recover rotational kinetic energy content within the vortex, thus allowing a stronger vortex to form while backpressure is present within the lower chamber.

In an example, a third chamber may be provided, which can be used for retrieving objects drawn-down through the whirlpool in the offset in the lower chamber of the toy and include the addition of the third chamber which is used for retrieving objects drawn-down through the whirlpool. The third chamber may be sloped to provide an easier view of the offset area of the lower chamber, e.g., to aid in retrieval of an object drawn down into the lower chamber.

In an example, vanes may be provided within lower chamber for directing water flow and objects drawn down into the lower chamber through the whirlpool toward drain and access from the third chamber.

An optional adapter may allow the user to alter the size and shape of the interior space outlet aperture, and may be fixable in place or movable during use so as to allow the user to alter the vortex/whirlpool dynamically. The adapter may have a shield portion blocking a portion of the vortex and an arm portion allowing the adapter to be moved or adjusted while a vortex/whirlpool is in progress. The arm portion may bend upwards, may pass through an inlet slot, or may pass through a special arm adjustment slot in the side of the side walls of the cylindrical interior.

Another example is a whirlpool toy for use in a partially enclosed household fixture having water therein and having a drain, the whirlpool toy comprising: a generally cylindrical body having a first generally cylindrical interior space, the body having a top allowing a clear view of the first interior space and at least one generally vertical side wall; a first outlet aperture in a bottom of the first interior space, the first outlet aperture located near a center of the bottom of the first interior space; a first lower chamber connected to the first interior space by the first outlet aperture, the first lower chamber having an open bottom of the first lower chamber offering a flow connection to the exterior of the device; and at least one inlet slot extending vertically up a portion of the at least one generally vertical side wall.

Another example is a whirlpool toy wherein the inlet slot further comprises: first and second edges of the slot, wherein the first edge is set further from a center of the interior space than the second edge, whereby the slot is disposed at along a chord line of the generally cylindrical body, whereby water entering the first interior space from such household fixture does not move in a straight line towards the center of the interior space.

Another example is a whirlpool toy, wherein the cylindrical side wall and the inlet slot and the bottom of the first interior space are substantially smooth, whereby water moving within the first interior space travels with smooth flow.

Another example is a whirlpool toy further comprising: at least one gasket dimensioned and configured to minimize leakage between the device and the bottom surface of the household fixture.

Another example is a whirlpool toy wherein the lower chamber is located, dimensioned and configured to offer unimpeded water flow from the lower chamber to such drain.

Another example is a whirlpool toy wherein the lower chamber is defined by the bottom of the first (upper) interior space, the side wall of the body and the surface of the household fixture.

Another example is a whirlpool toy wherein the top allowing a view of the interior of the device further comprises: an open top.

Another example is a whirlpool toy wherein the top allowing a view of the interior of the device further comprises: a transparent top.

Another example is a whirlpool toy further comprising: a vortex control adapter having a hand grip extension, a shield disposed at end of the hand grip extension, and at least one shield aperture passing through the shield, the shield being larger than the first outlet aperture and the first shield aperture being smaller than the first outlet aperture.

Another example is a whirlpool toy wherein the vortex control adapter further comprises: a second shield aperture passing through the shield, the second shield aperture being a different size than the first outlet aperture.

Another example is a whirlpool toy, wherein the edges of the inlet slot (or slots) are substantially streamlined to reduce flow separation within the inlet slot.

Another example is a whirlpool toy wherein the inlet slot further comprises: at least one entry vane directing water flowing through the inlet vane in a direction substantially perpendicular to the center of the first interior space.

Another example is a whirlpool toy wherein the hand grip extension further extends a sufficient distance to extend out of the first interior space, whereby the user may manipulate the adapter while the toy is generating a vortex.

Still other examples are described below and shown in the drawings. Modifications to these examples are also contemplated as being within the scope described herein as will be readily apparent to those having ordinary skill in the art after becoming familiar with all of the teachings herein.

FIG. 1 is a partially transparent perspective view of an embodiment of the device 100. Lower chamber 102 and upper chamber (defined by wall 118) are separated by a floor into two different chambers, connected only by interior space outlet aperture 112. A vortex may be easily formed in the upper chamber, while the lower chamber (defined by the bottom surface of the bathtub and the floor of the upper chamber) directs flow toward the bathtub drain which in enclosed by the lower chamber. Recuperation fin/vanes 110, may be included to recover kinetic energy from the vortex.

Inlet slot 104 is defined by inner slot wall 106 and accepts inlet flow 116, water which comes in from a large sink or bathtub partially full of water. Inner slot wall 106 channels and directs the flow to produce a desirable vortex flow 114.

Lip/gasket 108 helps seal the lower chamber from the ambient water in the household fixture so as to aid in preventing water from bypassing the upper chamber.

Figure 2:
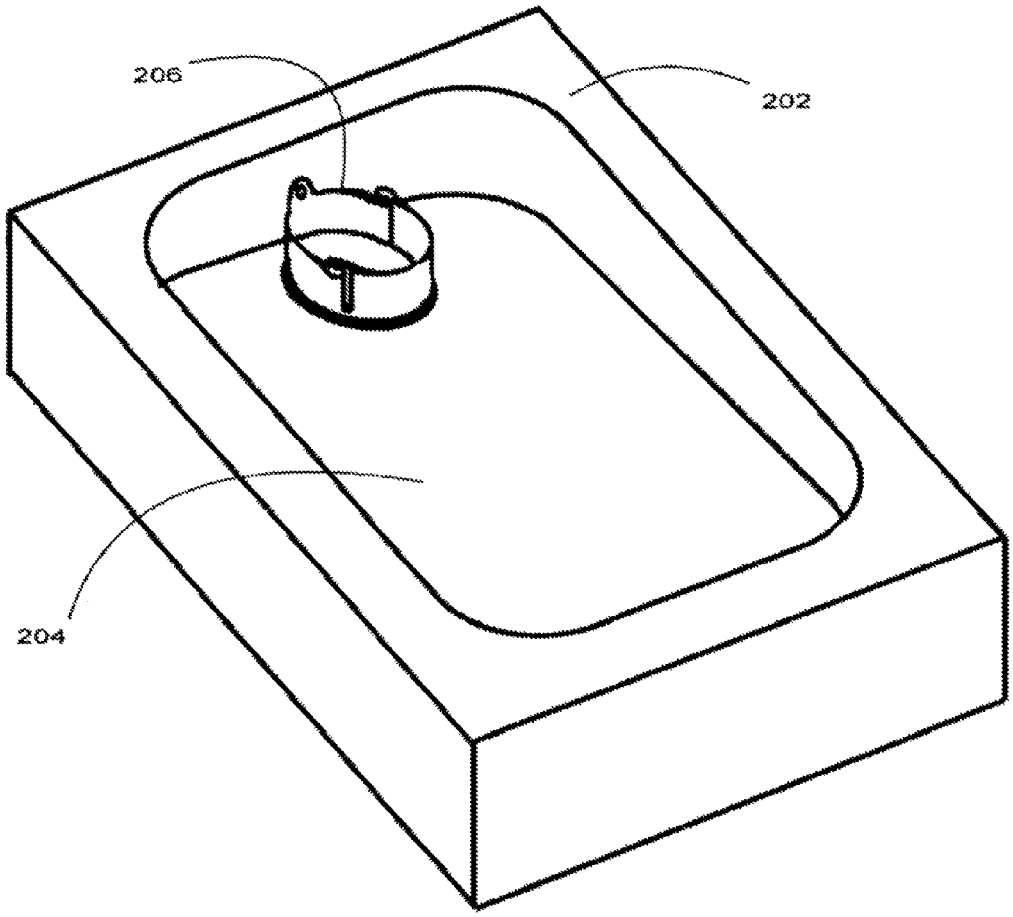
FIG. 2 is a perspective view of the embodiment shown in FIG. 1 illustrated in use in a household fixture such as a bathtub.

FIG. 2 is a perspective view of the embodiment shown in FIG. 1 in use in a household fixture such as a bathtub, sink, or other basin. Household fixture 202 may have a bottom of household fixture 204, which may not be entirely flat nor regular. Device 206 may be set into the fixture at a location over the drain from the device (drain not seen due to device 206). It will be appreciated that the central axis of the generally cylindrical device may be offset from the drain of the bathtub, thus allowing formation of a wider body and vortex within.

In use, the fixture is filled with water and the drain is opened. Gaskets and the body of the device 206 will impede water from directly exiting via the drain, and force it through the slots/apertures on the side of the device at which point, the rotating water within the device will swiftly organize into a well defined vortex, a result confirmed by testing.

Figure 3A:
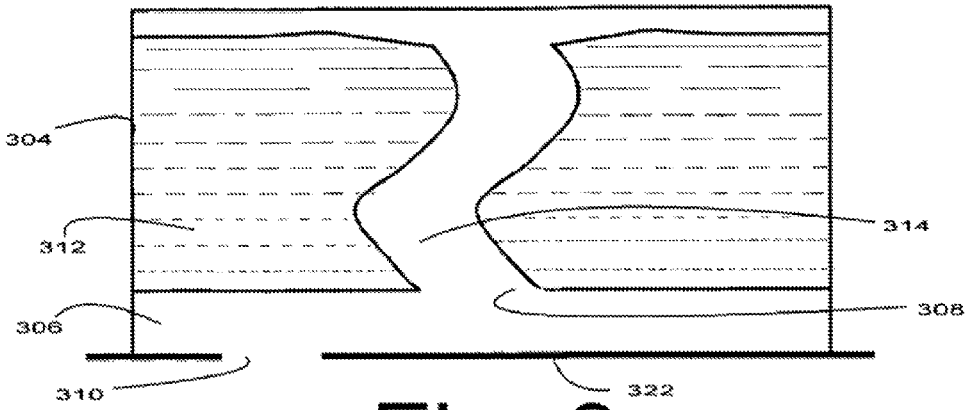
FIG. 3*a* is a cross-sectional diagram of another embodiment of the device, showing a possible vortex pattern.
Figure 3B:
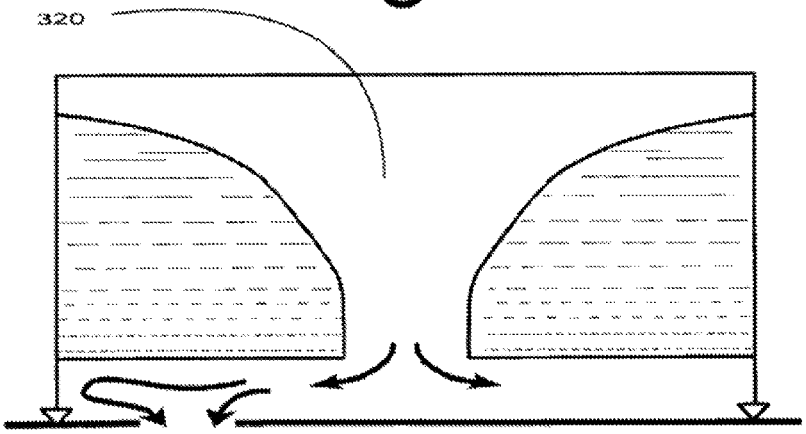
FIG. 3*b* is a cross-sectional diagram of another embodiment of the device, showing the typical water flow and vortex pattern.

FIG. 3*a* is a cross-sectional diagram of another embodiment of the device, showing a first possible vortex pattern, while FIG. 3*b* is a cross-sectional diagram of another embodiment of the device, showing a second possible vortex pattern. Device/sidewall 304 defines both the upper/vortex interior space and also lower chamber 306, which lower chamber is fed by water flowing out from interior space outlet aperture 308. Water may then exit the lower chamber 306 via the household fixture drain or via any opening if the chamber has a bottom with an aperture. A bottom of the chamber is felt to be less desirable in terms of forming a large vortex, as an open bottom would appear to offer the best possible flow. A gasket may be provided on sidewall 304 or may be omitted, depending on embodiment, construction techniques and materials of the sidewall and other considerations.

Water 312 may have within it either possible vortex 314, possible vortex 320, or any other myriad shapes including vortices which are not straight (see vortex 314) or are conical (vortex 320), and so on.

Water flow arrows mark desirably speedy water flow from the lower chamber 306. The household fixture bottom 322 may define the bottom of the lower chamber 306.

Figure 4:
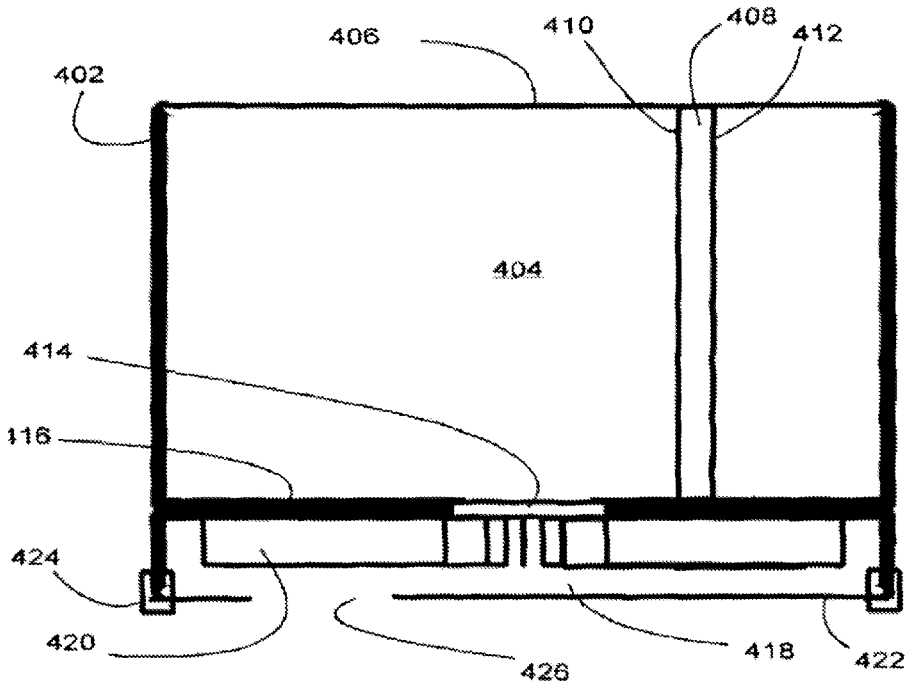
FIG. 4 is a cross sectional diagram of another embodiment of the device, showing details of the lower chamber with optional recuperation vanes.

FIG. 4 is a cross sectional diagram of another embodiment of the device, showing details of the lower chamber with recuperation vanes. Side wall 402 defines interior space 404 having top 406. In example embodiments, top 406 is an opening allowing users to experiment and play with the vortex, for example by feeling it, placing water toys into it, or using an adapter (explained in reference to FIG. 6) in a dynamic/interactive mode. In alternative embodiments, however, top 406 may be transparent, a smaller aperture, screened and so on.

Inlet slot 408 is defined by inlet slot edges 410, 412, while interior outlet aperture 414 may be clearly seen in the center of the interior bottom 416. The interior outlet aperture 414 may be placed at locations other than the center of the interior bottom 416 (that is, locations away from the center of the interior space 404) in alternative embodiments.

Lower chamber 418 (again defined by household fixture floor or bottom 422) may have therein vane/fin 420 or a plurality thereof, which may function to convert kinetic energy from the water entering the chamber via aperture 414 into pressure energy, which allows the formation of a stronger whirlpool while the lower chamber is under backpressure.

Gasket 424 may be seen more clearly as well. Note that the gasket 424 may in embodiments be eliminated, if the material of the device or the shape of the device allows a workable seal with the bottom of the bathtub/fixture.

It may be seen once again that the bathtub drain may be offset from the drain of the interior space/vortex chamber, and that the bathtub surface combines with the side walls of the body and the bottom of the vortex chamber to define the lower chamber.

Figure 5:
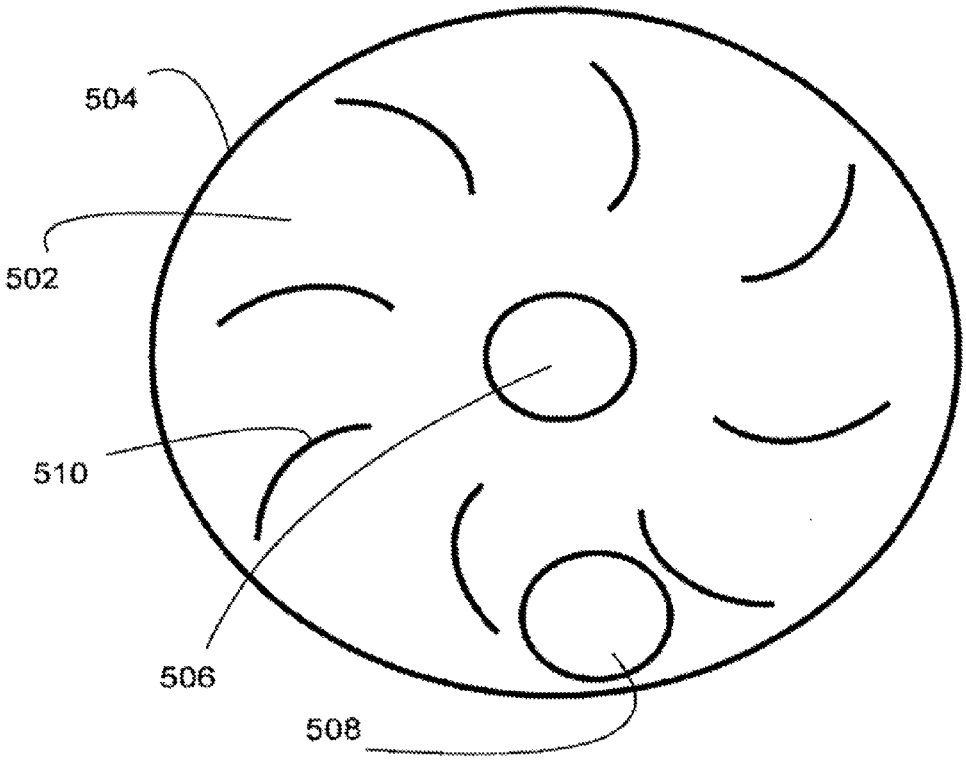
FIG. 5 is partially transparent bottom view of the device showing details of another embodiment and the lower chamber with optional recuperation vanes.

FIG. 5 is partially transparent bottom view of the device showing details of another embodiment and the lower chamber. Lower chamber 502 is defined by side wall of the lower chamber 504 and has interior outlet aperture 506 (which of course functions as an inlet for the lower chamber 502) and further has outlet aperture 508 (typically defined by the household drain. Vanes/fins 510 may be straight and still function to recover kinetic energy from the whirlpool vortex, or may be shallow curves, angled, bent and other shapes. Fins as used herein includes patterns of posts or pins, bumps, ridges, irregularities, and so on. The vanes/fins may extend entirely across the chamber from top to bottom, or may extend partially from either the top or bottom of the chamber, or may extend from the sides or center of the chamber, may be irregular, and may vary in number.

Figure 6:
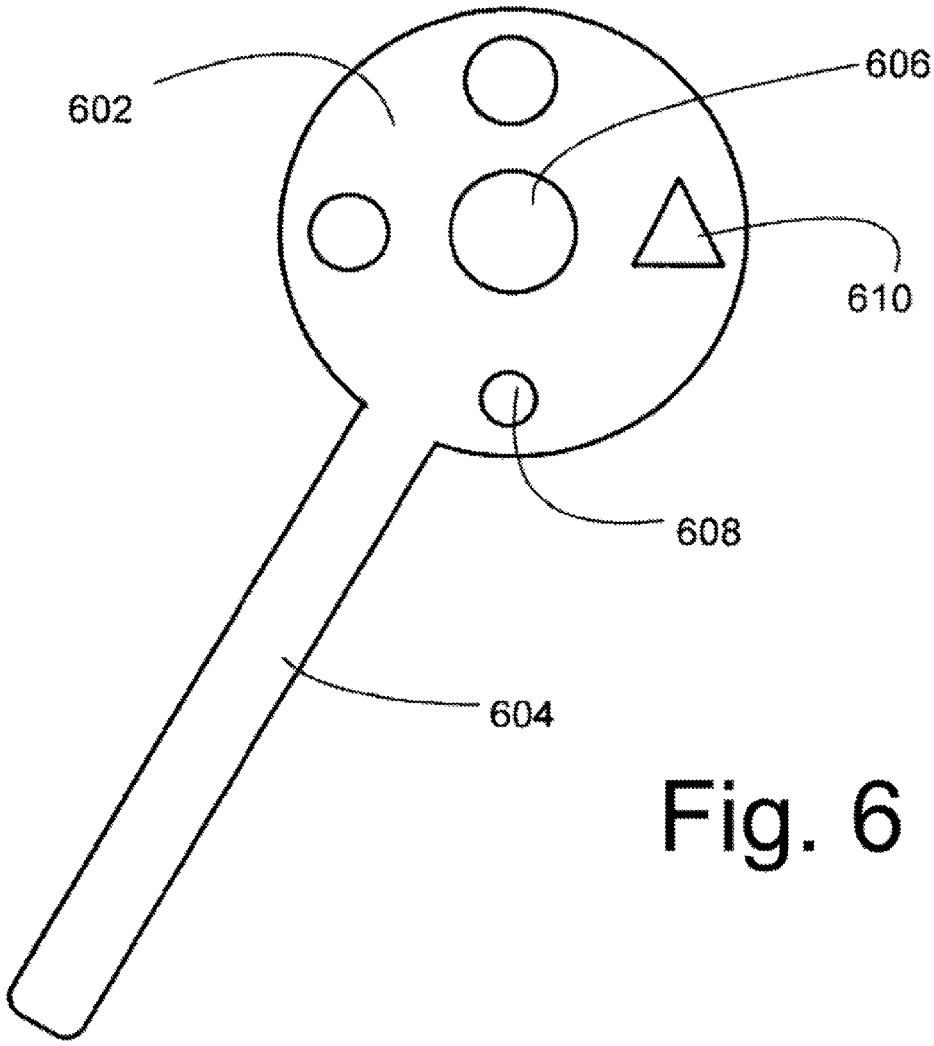
FIG. 6 is a planform view of an adapter for the device, allowing interactive and dynamic user control of the vortex.

FIG. 6 is a planform view of an adapter according to the device, allowing interactive and dynamic user control of the vortex. Adapter shield 602 may be a three dimensional shape or, as in the best mode now contemplated, may be substantially flat, and somewhat larger in size (radius) than the size (radius) of the interior space outlet aperture, on which it may optionally sit. Adapter shield hand grip extension 604 may allow easy manipulation of the adapter shield, especially during the time a vortex is actually being generated, so that the user may move the base of the vortex, switch to a smaller or larger opening or switch to an opening of different shape. Extension 604 may pass through one of the device's water inlet slots or may pass through a special slot made for the extension in the side walls of the body of the device.

First aperture 606 and second aperture 608 may be different sizes and may be different sizes (radii) from the size (radius) of the outlet aperture. Third aperture 610 may be a different shape than other apertures. In embodiments, the adapter may "plug in" or be otherwise secured in place in the bottom of the interior space. In such embodiments, the extension may be omitted, and the device may screw in or have attachments to secure it to the interior bottom.

Screens may be employed at diverse locations within the device, for example at the top, at the apertures, or as a bottom of the lower chamber, at the inlet slots and so on.

The device may have an "open bottomed" lower chamber, that is, the lower chamber may have no bottom, allowing water which flows into the lower chamber via the interior space outlet aperture to fall directly to the bottom of the bathtub.

Figure 7:
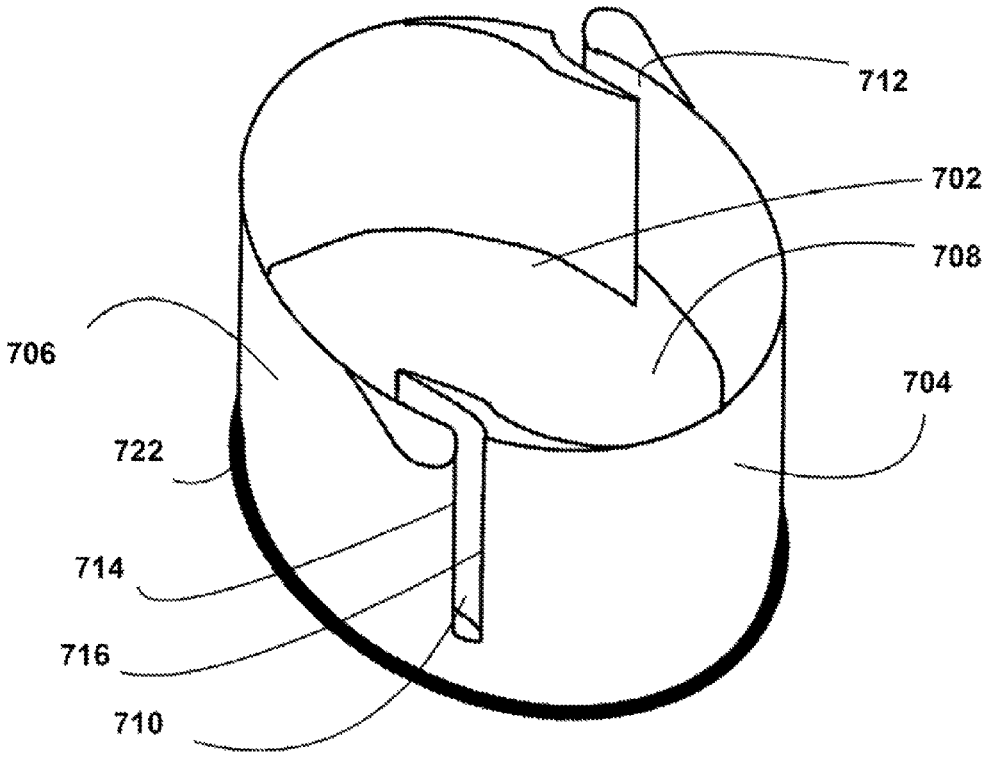
FIG. 7 is a perspective view of another embodiment of the device.

FIG. 7 is a perspective view of an embodiment of the device. In this perspective view, the center of the bottom, and the outlet is not visible, nor is the lower chamber located thereunder.

Interior space 702 has interior bottom 708 and first and second side walls 704, 706. Interior bottom 708 and side walls 704, 706 define the interior space, which is generally a regular cylinder having a round planform. (In alternative embodiments, the interior space could conceivably be shapes other than a circular column, such as an elliptical planform, or a frustum or conical shape, so long as water flow in enhanced by the shape.) Thus the overall device takes on the aspect of an open topped or clear topped barrel. The body of the device may be molded of plastic or other polymer, made of metal, wood, composites and other similar materials. The materials selected may be wholly or partially transparent.

Inlet slots 710, 712 allow water to flow into the interior space 702 from the water-filled household fixture in which it is placed. Inlets 710, 712 are defined by edges such as first slot edge 714 and second slot edge 716. It will be seen that the slot edges 714, 716 may be streamlined in shape so as to promote smooth water flow within the device in order to minimize pressure loss within the inlet vanes and promote even flow within the upper chamber. Slots 714, 716 may be set at an angle to the straight radial path to the center (not seen in FIG. 1) of the interior space. The angle of the slots will make a chord with the overall circular planform of the device, so water entering the device will enter traveling sideways, and the slots will tend toward the exact orthogonal so as to provide the largest angle possible to the flow within the barrel shaped interior space. Any number of such slots may be used, and the size and placement may be varied. The slots may also take the form of rows of apertures or rows of jets, which rows may be arrayed either vertically or horizontally or a combination of both, and this definition of slot is specifically included herein.

Handles may provide a convenient grip on other alternative embodiments of the device, and may further provide a location at which a lanyard, string, chain or the like may be secured.

Gasket 722 may be a relatively soft and conformable material which allows the device to conform to the bottom of typical household water fixtures like sinks and bathtubs. The conformance to the shape of the bottom of the bathtub or sink may force water exiting the fixture to pass through the device.

It will be appreciated that the dimensions of the device, especially the height and width, will alter the characteristics of the vortex created therein. For a single example, greater height provides a greater "head" of pressure to generate sideways motion and the vortex. It will be appreciated that the dimensions of the slots will dramatically alter the characteristics of the vortex in a similar manner.

Figure 8:
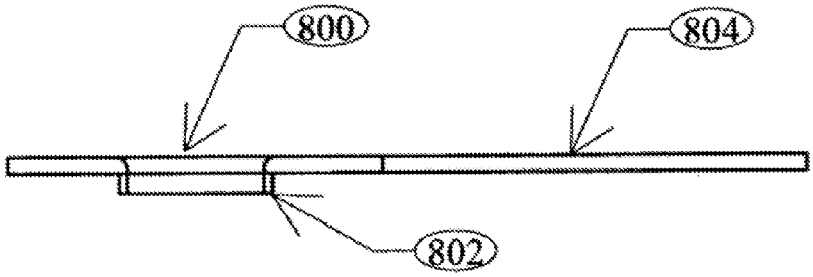
FIG. 8 is a side view of an adapter for the device.

FIG. 8 is a side view of an adapter for the device, showing details of the device aperture 800, which may have a lip 802 or gasket 802 allowing the aperture to be loosely seated within the interior space outlet aperture, whereby motions of the adapter handle extension 804 may move the vortex about. A gasket as the lip forces a larger portion of the water to pass through the vortex in order to escape the interior space.

Figure 9:
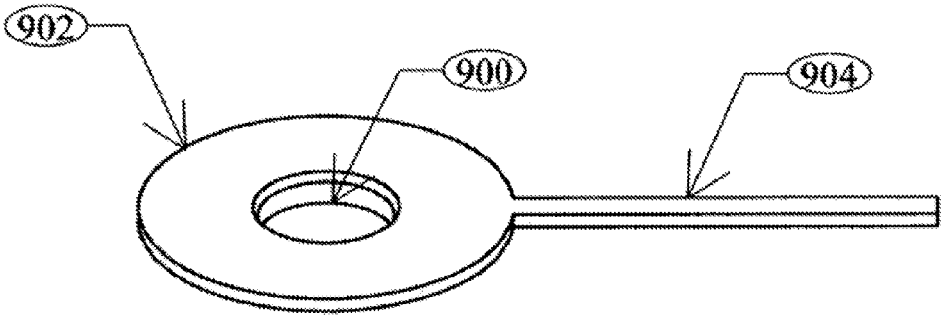
FIG. 9 is a perspective view of an adapter embodiment of the device.

FIG. 9 is a perspective view of an adapter. Aperture and lip/gasket 900 penetrate shield 902, which otherwise blocks exit of the water. Handle extension 904 may be as previously discussed.

Figure 10:
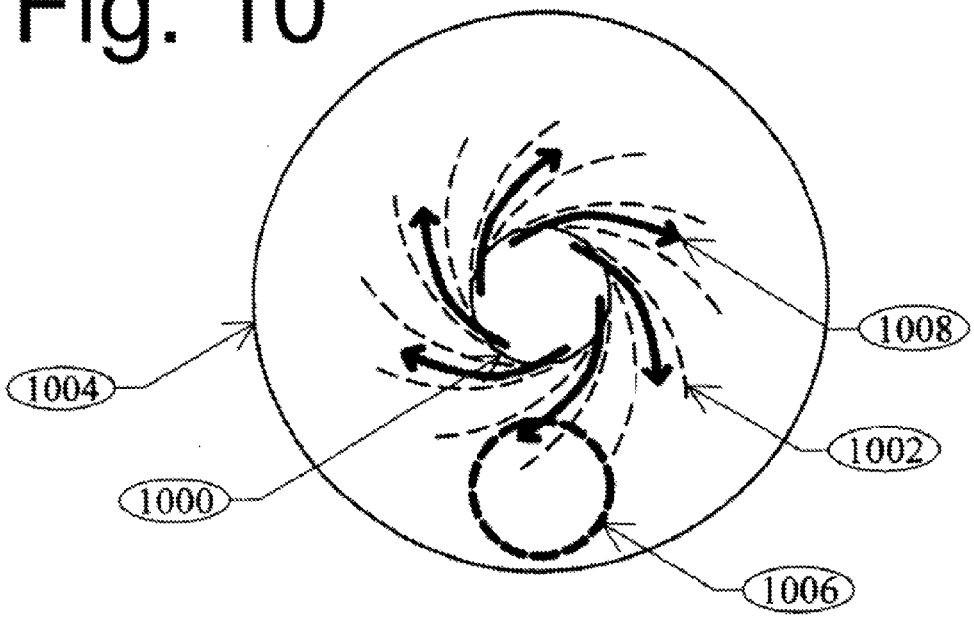
FIG. 10 is a bottom planform view of another embodiment of the lower chamber with optional recuperation vanes.
Figure 11:
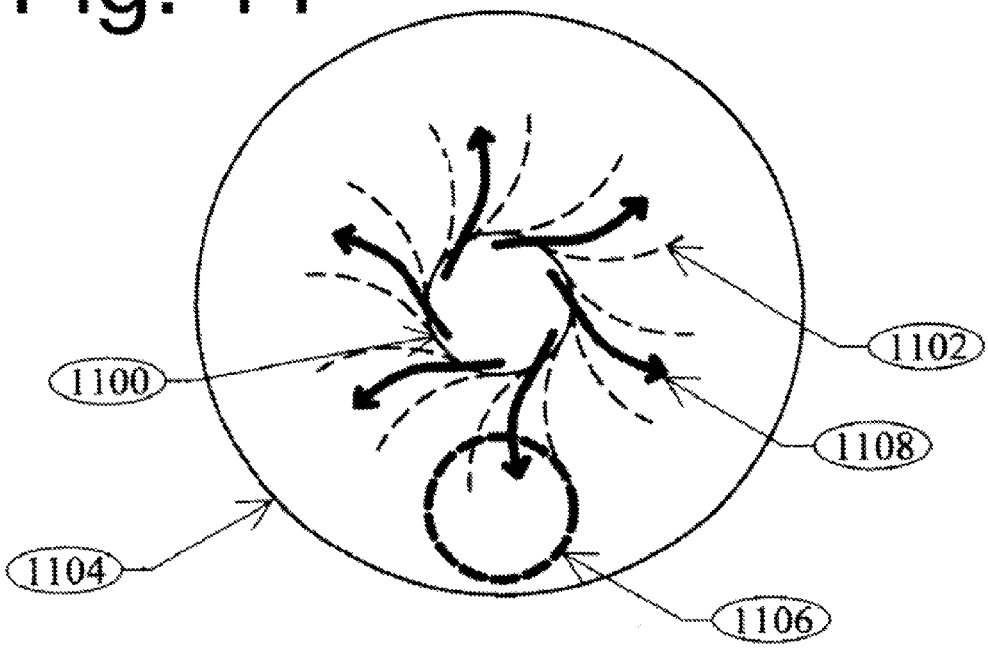
FIG. 11 is a bottom planform view of another embodiment of the lower chamber with optional recuperation vanes.

FIG. 10 is a bottom planform view of another embodiment lower chamber, and FIG. 11 is a bottom planform view of another embodiment lower chamber. Interior outlet apertures 1000/1100, gasket/lip 1004/1104, and household fixture drain 1006/1106 may be substantially as previously described in reference to FIGS. 1 through 9. However, it may be seen that vane/fin 1102/1002 may arc in two different directions, resulting in flow 1008/1108 going in either one of two different directions, depending upon the embodiment.

Figure 12A:
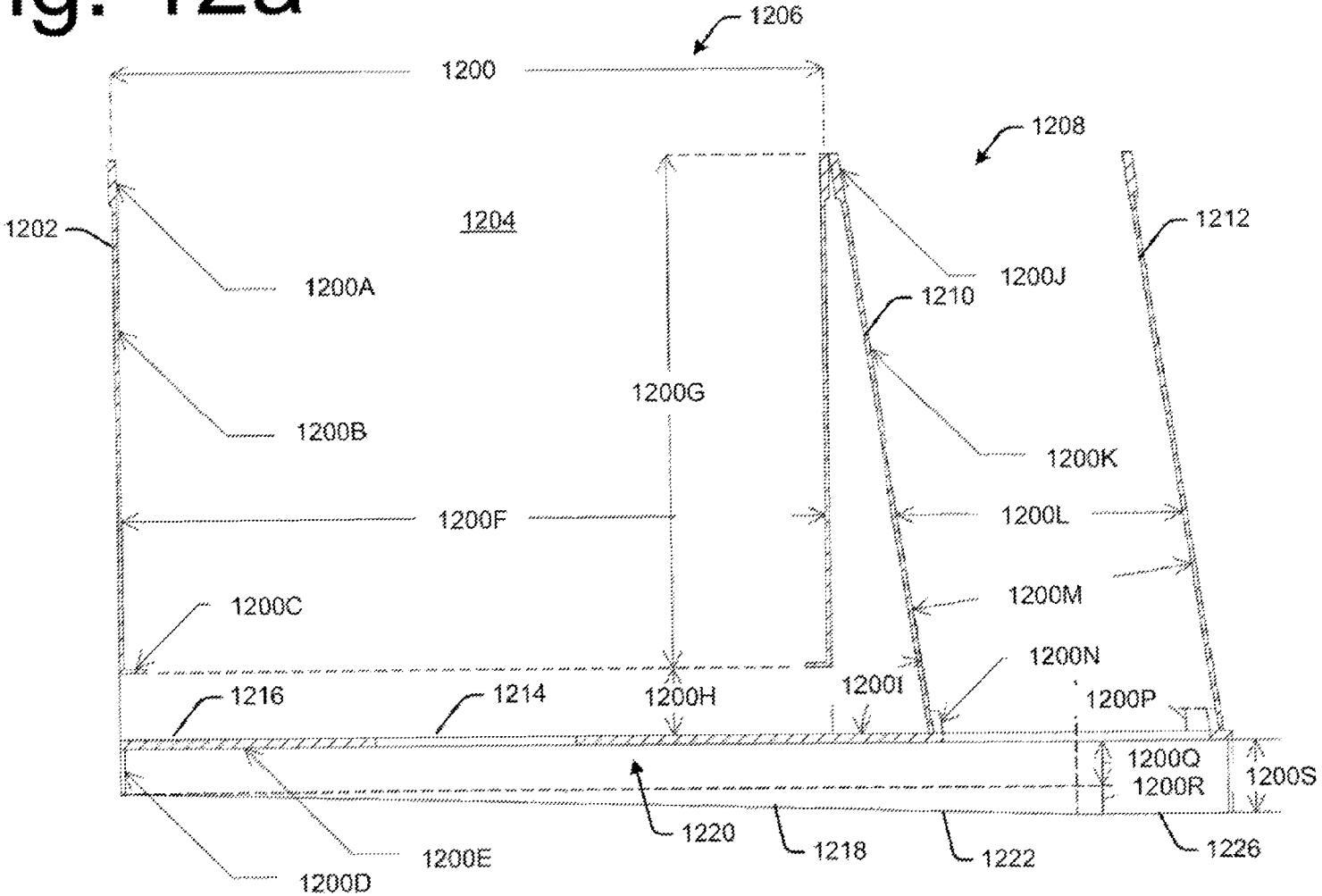
FIG. 12*a* is a side cross-sectional view of another embodiment of the device.

FIG. 12*a* is a side cross-sectional view of another embodiment of the device. Side wall 1202 defines interior space 1204 having top 1206. In example embodiments, top 1206 is an opening allowing users to experiment and play with the vortex, for example by feeling it, placing water toys into it, or using an adapter (explained in reference to FIG. 6) in a dynamic/interactive mode. In alternative embodiments, however, tcp 1206 may be transparent, a smaller aperture, screened and so on.

The third chamber 1208 is defined by sidewalls 1210 and 1212. The interior outlet aperture 1214 may be placed at locations other than the center of the interior bottom 1216 (that is, locations away from the center of the interior space 1204) in alternative embodiments.

Lower chamber 1218 (again defined by fixture bottom) may have therein vane/fin 1220 or a plurality thereof, which may function to direct water and objects drawn-down through the whirlpool to the extended portion of the lower chamber for object removal through the third chamber.

Gasket (not shown in FIG. 12*a*) may be used as well. Note that the gasket may in embodiments be eliminated, if the material of the device or the shape of the device allows a workable seal with the bottom of the bathtub/fixture.

It may be seen once again that the bathtub drain may be offset from the drain of the interior space/vortex chamber, and that the bathtub surface combines with the side walls of the body and the bottom of the vortex chamber to define the lower chamber.

In an example, the device shown in FIG. 12*a* may be configured according to the dimensions shown in Table 1. It is noted that these dimensions are only an example, and not intended to be limiting of the device in any way.

TABLE 1

| Example Dimensions | |
|---|---|
| Reference Number (shown in FIG. 12a) | Dimension (inches unless indicated otherwise) |
| 1200 | 8.0 |
| 1200A | 0.1 |
| 1200B | 0.05 |
| 1200C | 0.1 |
| 1200D | 0.05 |
| 1200E | 0.1 |
| 1200F | 7.9 |
| 1200G | 5.75 |
| 1200H | 0.75 |
| 1200I | 81.15° |
| 1200J | 0.1 |
| 1200K | 0.05 |
| 1200L | 3.2 |
| 1200M | 3.16 inches round |
| 1200N | 0.1 |
| 1200P | 0.25 |
| 1200Q | 0.5 |

TABLE 1-continued

| Example Dimensions | |
|---|---|
| Reference Number (shown in FIG. 12a) | Dimension (inches unless indicated otherwise) |
| 1200R | 0.3125 |
| 1200S | 0.8125 |

Figure 12B:
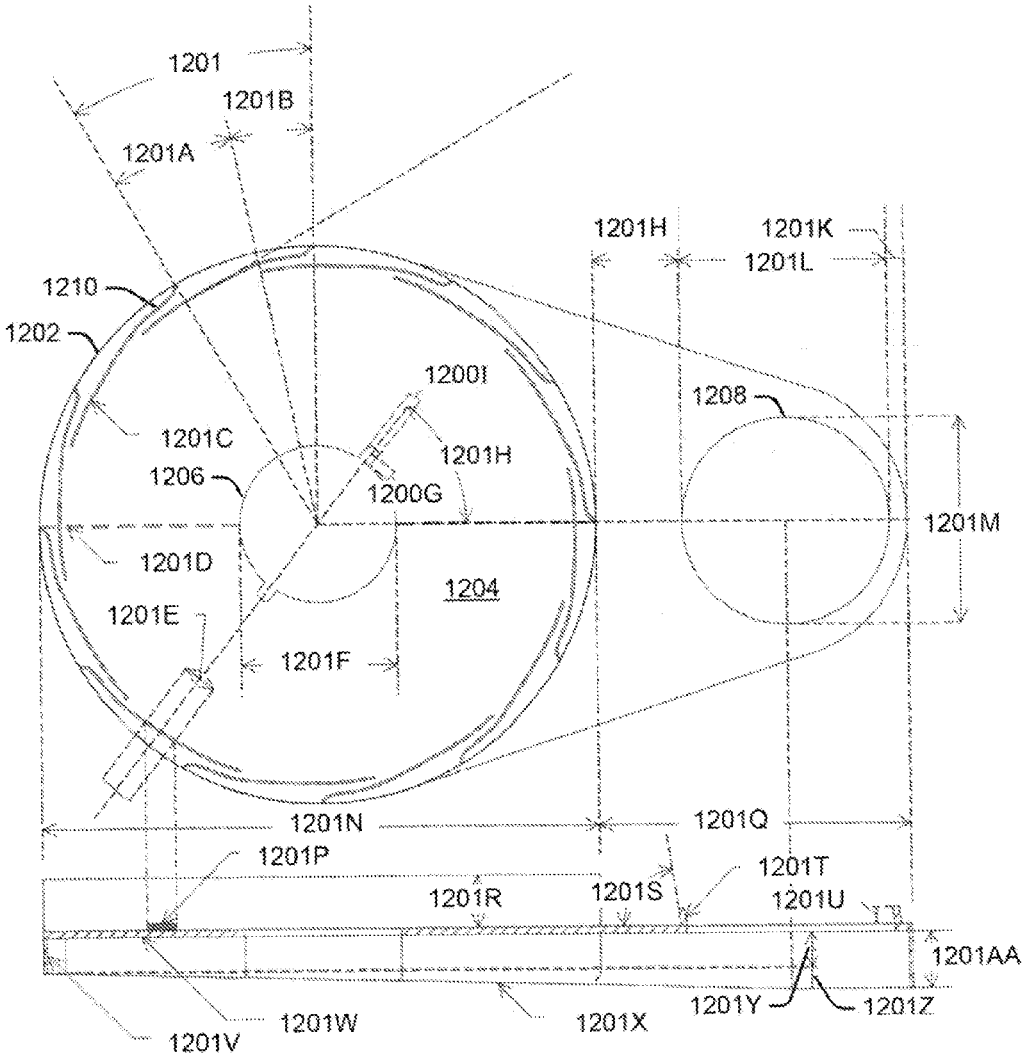
FIG. 12*b* is a top cross-sectional view of the embodiment of the device shown in FIG. 12*a*, shown aligned with the bottom portion of the side cross-section view shown in FIG. 12*a*.

FIG. 12*b* is a top view and cross-sectional view of the embodiment of the bottom portion of the device shown in FIG. 12*a*, less the upper walls enclosing the first interior space and the third chamber. Lower part of the first interior space 1202 is defined by the lower side wall of first interior space 1204 and has interior outlet aperture 1206 (which of course functions as an outlet for the first interior space 1202) and further has a third chamber which is located above the lower chamber 1208. Vanes/fins 1210 located in the lower wall of the first interior space function to direct water from the household fixture into the first interior space to promote the formation of to whirlpool within the first interior space. The vanes/fins and associated lower wall of the first interior space may extend from top to bottom of the first interior space, or may extend partially from either the top or bottom of the chamber.

In an example, the device shown in FIG. 12*b* may be configured according to the dimensions shown in Table 2. It is noted that these dimensions are only an example, and not intended to be limiting of the device in any way.

TABLE 2

| Example Dimensions | |
|---|---|
| Reference Number (shown in FIG. 12b) | Dimension (inches unless indicated otherwise) |
| 1201 | 30° |
| 1201A | 18° |
| 1201B | 12° |
| 1201C | vane: 0.03 inches thick; 0.75 inches high |
| 1201D | vane: 0.03 inches thick (lower chamber) |
| 1201E | 0.5 inch wide slot |
| 1201F | 2.25 |
| 1201G | 0.15 |
| 1201H | 52° |
| 1201I | 0.2 |
| 1201J | 1.25 |
| 1201K | 0.25 |
| 1201L | 3.0 |
| 1201M | 2.96 |
| 1201N | 8.0 |
| 1201P | 0.1 |
| 1201Q | 4.5 |
| 1201R | 0.75 |
| 1201S | 81.15° |
| 1201T | 0.1 |
| 1201U | 0.25 |
| 1201V | 0.05 inches thick |
| 1201W | 0.1 inches thick |
| 1201X | vane: 0.03 inches thick (lower chamber) |
| 1201Y | 0.5 |
| 1201Z | 0.3125 |
| 1201AA | 0.8125 |

Figure 13A:
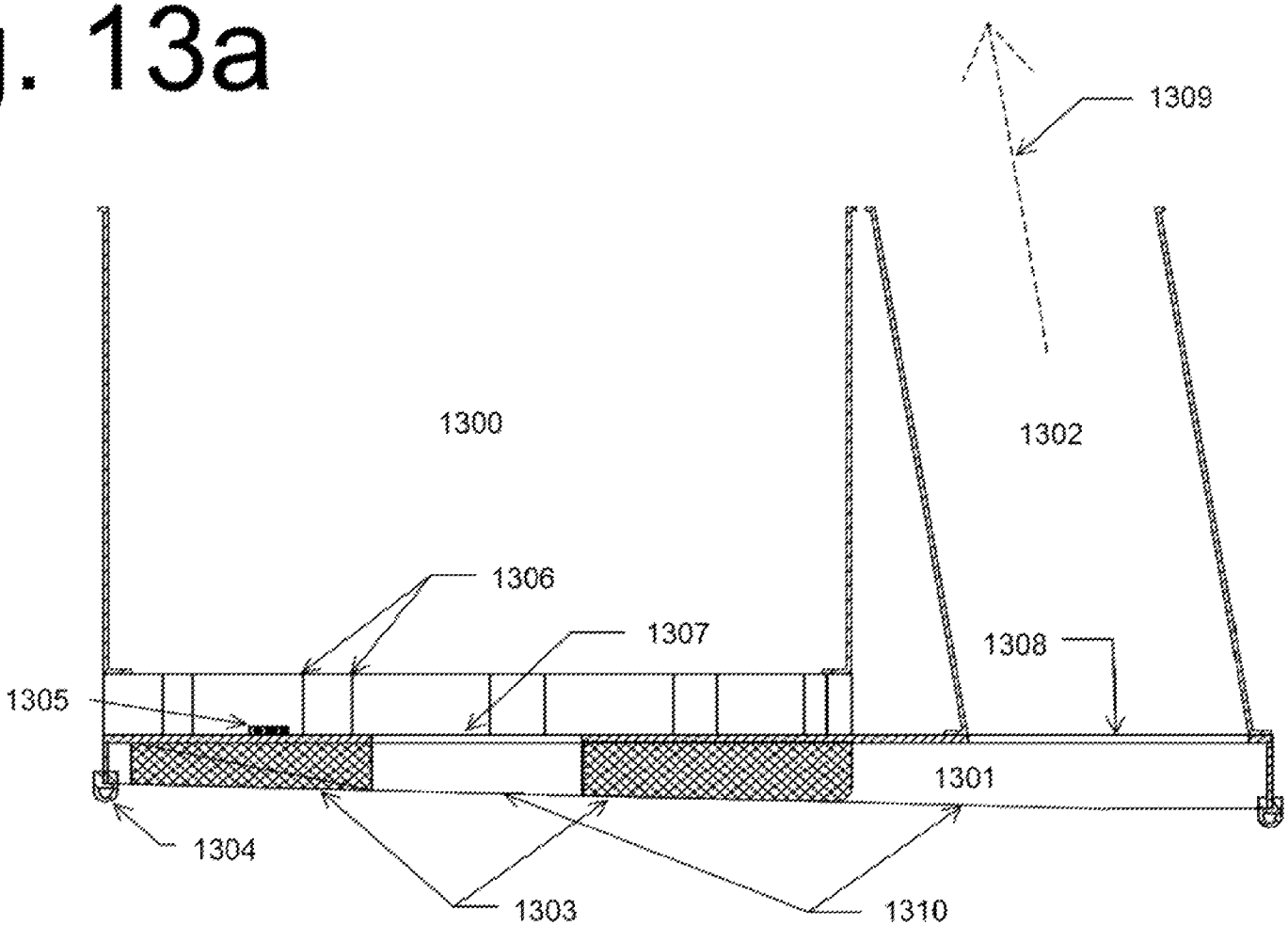
FIG. 13*a* is a side cross-sectional view of another embodiment of the device.
Figure 13B:
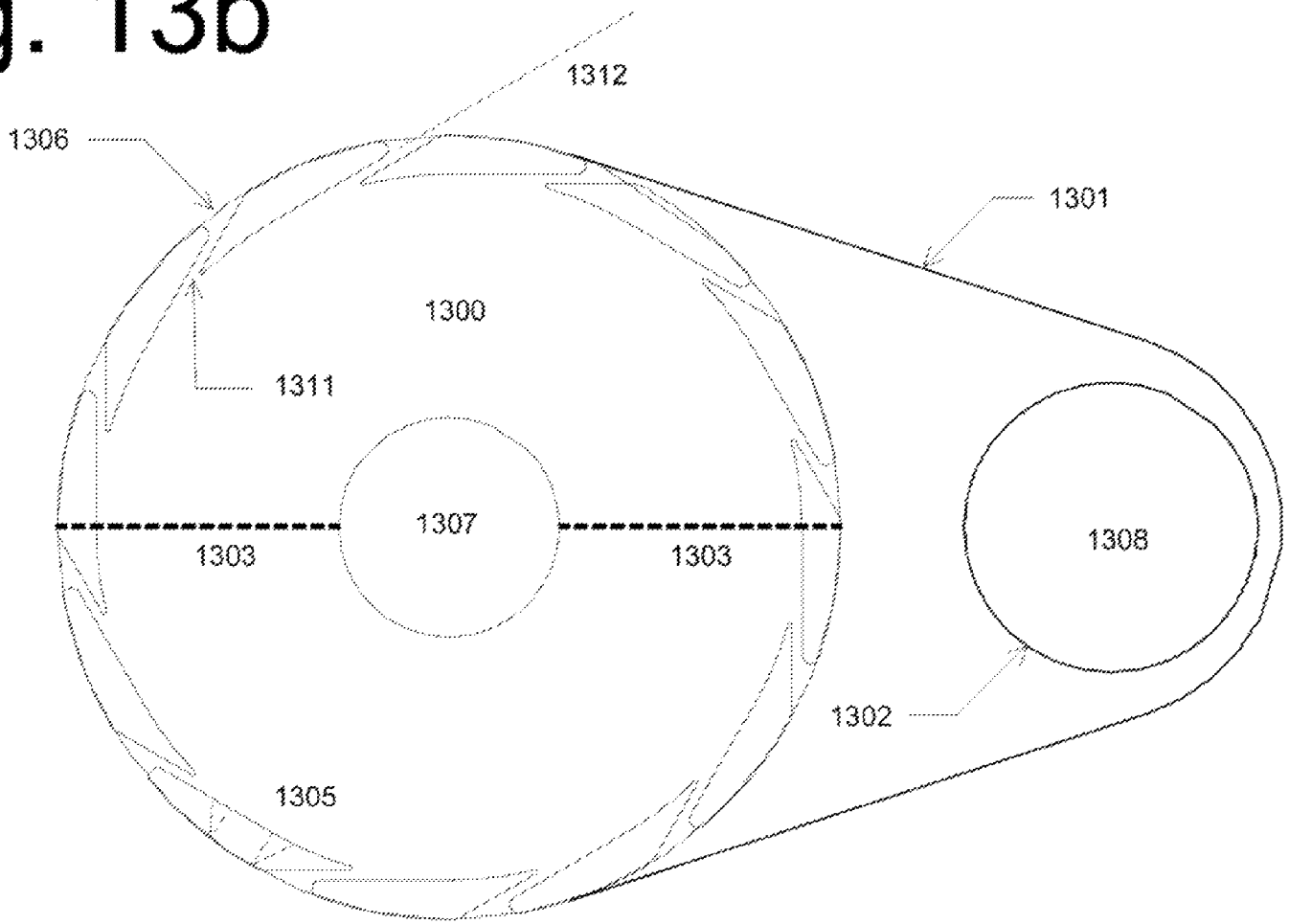
FIG. 13*b* is a top cross-sectional view of the embodiment of the device shown in FIG. 13*a*.

FIG. 13*a* is a side cross-sectional view of another embodiment of the device. FIG. 13*b* is a top view of the embodiment of the device shown in FIG. 13*a*. FIG. 13*b* shows first interior space. The device is including a first interior space 1300 (also referred to herein as a first chamber, or first upper chamber). The device also includes an offset area from the lower chamber 1301 (also referred to as the second chamber), and another upper chamber 1302 (also referred to as the third chamber).

The device may also include a directional vane 1303. The directional vane may be used for directing water and objects (e.g., floating toys) into the offset area of the lower chamber, e.g., for retrieval through the second upper chamber.

A gasket 1304 may also be provided. It is noted that the weight of water in the chamber(s) may work in combination with the gasket 1304 to seal or substantially seal the device to the floor of the water fixture.

A slot 1305 may be provided within the wall of the upper chamber. Slot 1305 may be used for inserting a "wand" -type aperture handle. A slot inlet 1306 may be provided within the lower wall of the upper chamber. The slot inlet 1306 may be used for introducing swirling water into the upper chamber.

A central aperture 1307 may be provided between the upper and lower chambers. An opening 1308 may be provided between the third chamber 1302 and the lower chamber for retrieval of objects through the third chamber 1302.

The third chamber may be sloped (as illustrated by arrow 1309) to aid in viewing the bottom of the offset area 1301 of the lower chamber, e.g., to aid in the retrieval of an object drawn down into the lower chamber. In addition, the bottom wall or floor 1310 of the lower chamber may also be sloped to conform to the slope of a typical bathtub or other fixture.

It is noted with reference to FIG. 13*a*, that the device has a second upper chamber 1309 and an alternate slot configuration (e.g., as compared to the device shown in FIG. 12*b*).

A slot outlet 1311 can be seen in FIG. 13*b*, formed within the lower wall of the upper chamber for introducing swirling water into the upper chamber. Also shown in FIG. 13*b* is a slot 1312 formed within a wall of the upper chamber for directing water in tangential direction to the wall to produce a swirling flow pattern within the upper chamber.

It is noted that the exemplary embodiments shown and described are provided for purposes of illustration and are not intended to be limiting. Still other embodiments are also contemplated.

The invention claimed is:

1. A whirlpool toy for use in a partially enclosed household fixture having water therein and having a drain, the whirlpool toy comprising:

a generally cylindrical body having a generally cylindrical upper chamber, the body having a top providing a view of the upper chamber and at least one generally vertical side wall;

a first outlet aperture in a bottom of the upper chamber, the first outlet aperture located near a center of the bottom of the upper chamber;

a lower chamber connected to the upper chamber by the first outlet aperture, the lower chamber having an open bottom offering a flow connection to the exterior of the toy, the lower chamber extending beyond and offset from the upper chamber;

at least one inlet slot extending vertically up a portion of the at least one generally vertical side wall; and a third chamber extending above an extended portion of the lower chamber with walls of the third chamber extending to a same height as walls of the first generally cylindrical upper chamber, wherein the third chamber is configured for retrieving objects drawn into the lower chamber through a whirlpool in the upper chamber during use.

2. The whirlpool toy of claim 1, wherein the third chamber is configured to vent air from the lower chamber during use.

3. The whirlpool toy of claim 1, wherein the lower chamber further comprises vanes to direct flow toward an extended portion of the lower chamber.

4. The whirlpool toy of claim 1, wherein the third chamber is sloped to provide a view of an extended area of the lower chamber to aid in retrieving an object drawn into the lower chamber.

5. The whirlpool toy of claim 1, wherein the lower chamber further comprises: vanes located within the lower chamber and disposed so as to recover rotational kinetic energy content within a whirlpool vortex formed within the upper chamber so that a stronger vortex forms when backpressure is present within the lower chamber.

6. The whirlpool toy of claim 1, further comprising a plunger within the third chamber to pump water from the lower chamber.

7. The whirlpool toy of claim 1, further comprising kinetic energy recovery vanes to at least partially recover kinetic energy from a whirlpool formed in the upper chamber.

8. The whirlpool toy of claim 1, further comprising:

a plunger within the third chamber to pump water from the lower chamber, and kinetic energy recovery vanes to at least partially recover kinetic energy from a whirlpool formed in the upper chamber.

9. The whirlpool toy of claim 1, wherein the inlet slot further comprises: first and second edges of the slot, wherein the first edge is set further from a center of an interior space than the second edge, whereby the slot is disposed along a chord line of the generally cylindrical body, whereby water entering the upper chamber from said household fixture does not move in a straight line towards the center of the interior space.

10. The whirlpool toy of claim 1, wherein the cylindrical side wall and the inlet slot and the bottom of the upper chamber are substantially smooth, whereby water moving within the upper chamber travels in a flow selected from the group consisting of: laminar flow, turbulent flow, and combinations thereof.

11. The whirlpool toy of claim 1, wherein water pressure on an upper surface of the lower chamber seals a gasket at an interface between the toy and a surface of the household fixture.

12. The whirlpool toy of claim 1, wherein edges of the inlet slot are substantially streamlined to reduce flow separation with the inlet slot.

13. A method comprising:

providing a whirlpool toy with a generally cylindrical body having a first substantially cylindrical interior space and at least one substantially vertical side wall;

providing a first outlet aperture in a bottom of the first interior space;

connecting a second interior space to the first interior space by the first outlet aperture;

extending at least one inlet slot vertically up at least a portion of the at least one generally vertical side wall;

providing a third interior space adjacent the first interior space above an extended portion of the second interior space with walls of the third interior space extending to a same height as walls of the first substantially cylindrical interior space, wherein the third interior space is configured for retrieving objects drawn into the second interior space through a whirlpool in the first interior space.

14. The method of claim 13, wherein the second interior space is provided lower than the first interior space and the third interior space.

15. The method of claim 13, further comprising venting air from the second interior space through the third interior space.

16. The method of claim 13, wherein the second interior space further comprises vanes to direct flow toward the extended portion of the second interior space.

17. A method comprising:

providing a whirlpool toy with a generally cylindrical body having a first substantially cylindrical interior space and at least one substantially vertical side wall;

providing a first outlet aperture in a bottom of the first interior space;

connecting a second interior space to the first interior space by the first outlet aperture, wherein the second interior space is provided lower than the first interior space; and extending at least one inlet slot vertically up at least a portion of the at least one generally vertical side wall; and providing a third interior space extending above an extended portion of the second interior space with walls of the third interior space extending to a same height as walls of the first substantially cylindrical interior space, wherein the third interior space is configured for retrieving objects drawn into the second interior space through a whirlpool in the first interior space.

18. The method of claim 17, further comprising providing a flow connection through an open bottom in the second interior space to the exterior of the toy.

19. The method of claim 17, wherein the third interior space is configured to vent air from the second interior space during use, and wherein the second interior space further comprises vanes to direct flow toward the extended portion of the second interior space.

* * * * *